United States Patent [19]

Evans

[11] Patent Number: 4,657,084

[45] Date of Patent: Apr. 14, 1987

[54] TWIN SEAL WELL PACKER

[75] Inventor: Robert W. Evans, Huntsville, Tex.

[73] Assignee: Hughes Tool Company, Houston, Tex.

[21] Appl. No.: 777,056

[22] Filed: Sep. 17, 1985

[51] Int. Cl.[4] ..... E21B 23/00

[52] U.S. Cl. ..... 166/387; 166/120; 166/134

[58] Field of Search ..... 166/120, 92, 140, 134, 166/191, 387, 313, 97.5

[56] References Cited

U.S. PATENT DOCUMENTS

| | | | |
|---|---|---|---|
| 3,106,961 | 10/1963 | Bigelow | 166/313 |
| 4,373,584 | 2/1983 | Silberman et al. | 166/313 |
| 4,375,240 | 3/1983 | Baugh et al. | 166/387 |
| 4,413,677 | 11/1983 | Perkins | 166/120 |
| 4,505,332 | 3/1985 | Mills et al. | 166/387 |

OTHER PUBLICATIONS

C6-80-062 "Twin Seal Submersible Pump Packer".

*Primary Examiner*—Stephen J. Novosad

*Assistant Examiner*—William P. Neuder

*Attorney, Agent, or Firm*—Charles D. Gunter, Jr.

[57] ABSTRACT

A well packer is shown of the type having a packer head and a pair of tubular extending downwardly therefrom. An upper seal, a gripping assembly, a lower seal and a lock body are all located about the mandrels extending successively downwardly from the packer head. An actuator within the lock body is provided for effecting outward radial movement of the seals and gripping assembly to seal and grip a surrounding well conduit. A push rod extending from the lock body through the lower seal to the gripping assembly moves the gripping assembly, as a unit, in the direction of the upper seal to compress the upper seal before the lower seal is compresed. A tie rod extends from the packer head through the upper seal to the gripping assembly and carries a locking mechanism which allows unidirectional movement of the gripping assembly with respect to the upper seal whereby sealing force applied to the upper seal from the gripping assembly is locked into the upper seal.

7 Claims, 17 Drawing Figures

TWIN SEAL WELL PACKER

BACKGROUND OF THE INVENTION

1. Field of the Invention

This invention relates to well packers of the type used for sealing a cylindrical member to a circumscribing conduit in a well bore such as, for example, sealing a tubing string to a surrounding casing or well liner.

2. Description of the Prior Art

Well packers are known for selectively sealing and/or anchoring a tubing string to a surrounding well conduit or liner. Such devices are known which can be set in the sealing/anchoring configuration by manipulation of a tubing string from which the packer is suspended, or by application of hydraulic pressure by means of the tubing string. Such devices are also known which can be released from the set configuration and retrieved from the well by appropriate manipulation of the tubing string.

In many applications, the well packer assembly includes gripping and sealing elements which are located concentrically about a single cylindrical tubing member. The gripping and sealing elements are movable radially between relaxed and extended positions for gripping and sealing a surrounding conduit. Dual string packers are also known in which a pair of tubular mandrels extend through the body of the packer with the gripping and sealing elements circumscribing both of the tubular mandrels. Dual string well packers are also known which feature a sealing element located on either side of the gripping elements to form a "twin seal" arrangement.

In setting the twin seal, dual string packer, it is desirable to eliminate the need for mandrel movement. Particularly in the case of a production packer, where each of the dual tubing strings may extend for great lengths, it is important that the packer be set in sealing engagement with the surrounding well conduit without causing relative movement between the tubing strings. It is also important in a twin seal packer of the type described that the upper seal element be compressed and the gripping elements engaged before the lower seal element is compressed. By locking the setting force of the packer into the upper seal element before compressing the lower seal element, the lower seal does not "drag" on the surrounding well conduit, and the tubing strings below the packer are not placed in compression.

These and other objects will be accomplished by the improved twin seal, dual string packer which is described in the specification which follows.

SUMMARY OF THE INVENTION

The well packer of the invention is of the type having a packer head and a pair of tubular mandrels which extend downwardly therefrom. An upper seal is located about the mandrels below the head, a gripping assembly is located about the mandrels below the upper seal, and a lower seal is located about the mandrels below the gripping assembly. A lock body is located about the mandrels below the lower seal and actuator means within the lock body are provided for effecting outwardly radial movement of the seals and gripping assembly to seal and grip a surrounding well conduit.

The improved packer has a push rod which extends from the lock body through the lower seal to the gripping assembly for moving the gripping assembly, as a unit, in the direction of the upper seal to compress the upper seal before the lower seal is compressed. A tie rod extends from the packer head through the upper seal to the gripping assembly. Lock means associated with the tie rod allow unidirectional movement of the gripping assembly with respect to the upper seal, whereby sealing force applied to the upper seal from the gripping assembly is locked into the upper seal.

Additional objects, features and advantages will be apparent in the written description which follows.

DETAILED DESCRIPTION OF THE INVENTION

Figure 1A:
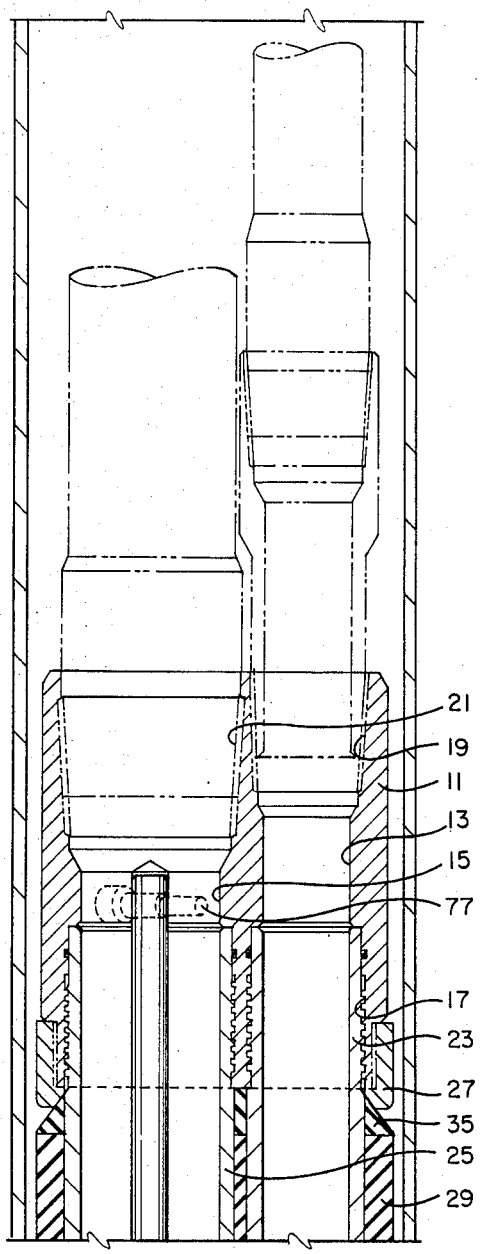
FIGS. 1A–1D are side, cross-sectional views of the well packer of the invention showing successive downward continuations of the packer in the relaxed or running-in position.

FIG. 1A shows the upper portion of the well packer of the invention. The well packer includes a solid packer head 11 having a pair of internal passages 13, 15 and an internally threaded lower extent 17. The internal passages 13, 15 are provided with threaded outer extents 19, 21, respectively, for connection to a pair of tubing strings (shown in dotted lines in FIG. 1A) extending upwardly to the well surface.

Figure 1B:
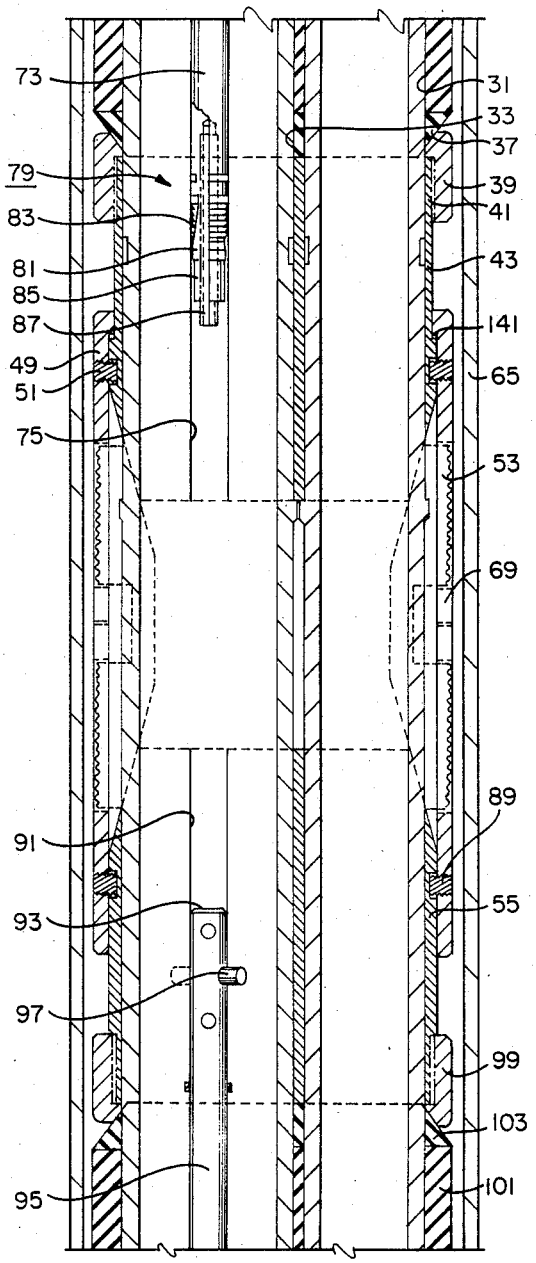

A pair of tubular mandrels 23, 25 extend downwardly from the packer head 11 and are surrounded by an abutment ring 27 which separates the packer head 11 from an upper resilient seal 29. The upper seal 29 can be made from a traditional elastomer, a special purpose elastomeric material such as tetrafluoroethylene, or other special purpose elastomer selected for its resistance to corrosive fluids and designed for use in high temperature, high pressure environments. As shown in FIGS. 1A and 1B, the upper seal 29 is a solid block of elastomer having openings 31, 33 there through, to allow the tubular mandrels 23, 25 to pass through the seal. The upper seal 29 can also have secondary seal sections 35, 37 on either side thereof made from an elastomer which is reinforced with knitted elements. These elements are preferably formed as a continuously series of interlocking ductile, metal-containing loop members. Such elements are described in U.S. Pat. No. 2,761,203 entitled "Resilient Gasket Forming Material and Method of Reducing Same" and are commercially available from the Metex Corporation of Addison, N.J.

A lower abutment ring 39 is carried below the secondary seal section 37 about the tubular mandrels 23, 25 and is received upon an upper extent 41 of an upper cone 43. Upper cone 43 is one component of the gripping assembly of the device which is shown in exploded fashion in FIG. 7. The upper cone 43 is a solid metal body which has two passageways 45, 47 cut therethrough to allow the tubular mandrels 23, 25 to pass through the body of the cone. The upper cone 43 is received within one end a slip cage 49 and initially is pinned to the cage 49 by one or more shear pins 51.

Figure 7:
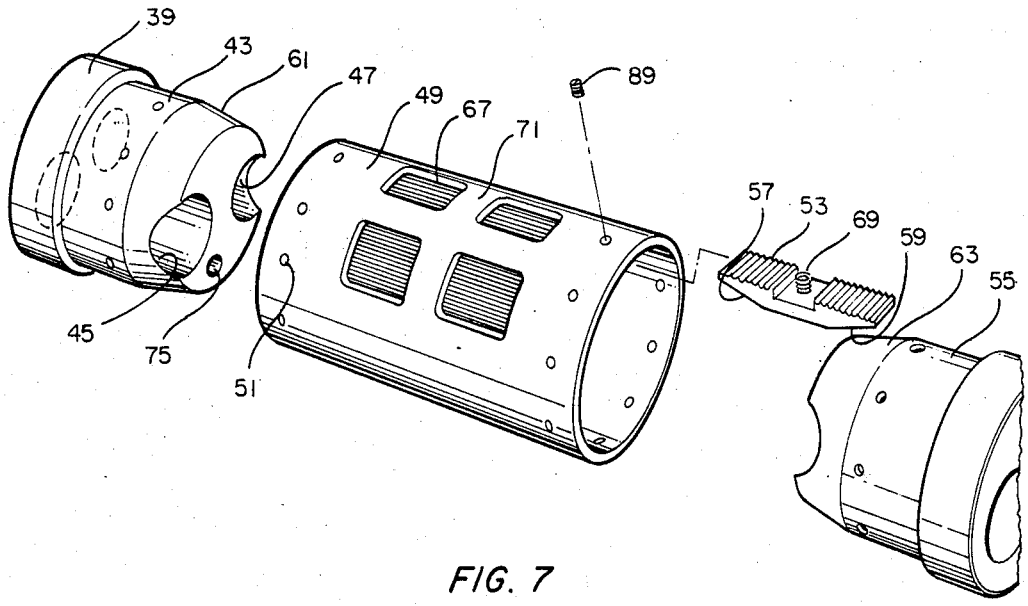
FIG. 7 is an isolated, exploded view of the gripping assembly of the well packer.

One or more gripping slips 53 are located intermediate the upper cone 43 and a lower cone 55 within the cage 49. As shown in FIGS. 1B and 7, the slips 53 have lower tapered surfaces 57, 59 which are engaged by tapered surfaces 61, 63 of the upper and lower cones, respectively, to move the slips 53 between retracted and extended radial positions to grip the surrounding well casing 65. The slips 53 are initially retained in a retracted position within the slip windows 67 of the cage 49, as by a spring element 69 which is received behind the rib 71 in the slip window.

Figure 6:
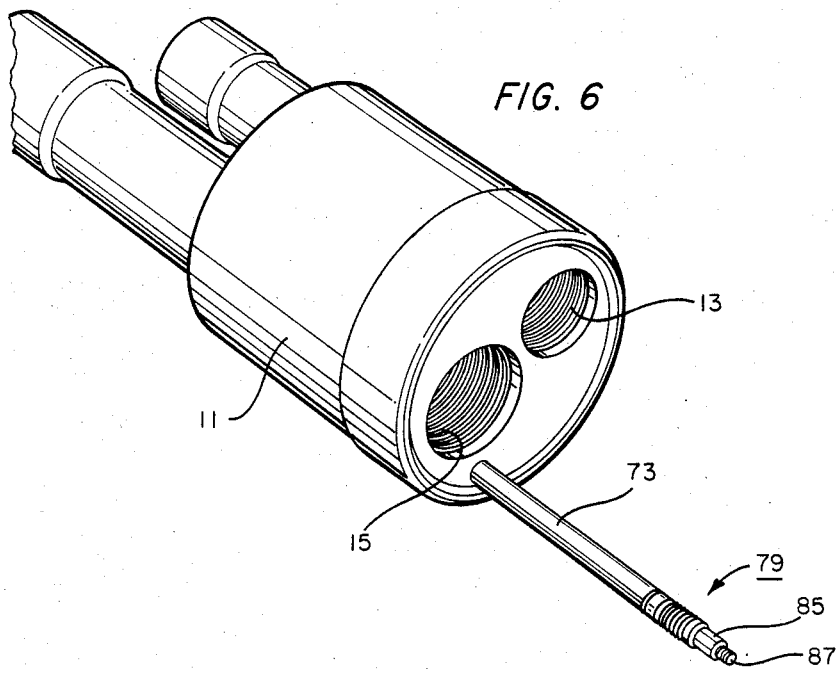
FIG. 6 is an isolated, perspective view of the head section of the well packer of the invention showing the tie rod extending from the packer head.

As shown in FIGS. 1A and 1B, the packer head 11 has a tie rod 73 which extends downwardly from the packer head within the body of the tool parallel to the longitudinal axis of the tool. The tie rod 73 passes through a passageway provided in the upper seal 29 and into a passageway 75 (FIG. 7) provided through the body of the upper cone 43. For ease of illustration, the tie rod 73 is shown in FIGS. 1A–1B as being in the same plane as the tubular mandrel 23. Actually, as is evident from FIGS. 6 and 7, the tie rod 73 passes through the upper seal and into the upper cone at a different circumferential location. The tie rod 73 is initially restrained within the packer head 11 by means of a shear pin 77 (shown in dotted lines in FIG. 1A).

As shown in FIGS. 1A–1B, 6 and 7, a lock means 79 is associated with the tie rod 73 for allowing unidirectional movement of the gripping assembly and upper cone with respect to the upper seal 29, whereby sealing forces applied to the upper seal 29 from the gripping assembly are locked into the upper seal. As shown in FIG. 1B, the lock means 79 can include a cone 81 having an outer tapered surface and a slip ring 83 with an outer serrated surface for engaging the walls of the passage way 75 in the upper cone 43. The cone and slip ring 81 and 83 are initially held on the tie rod 73 by means of a nut 85 which can be threaded on the outer extent 87 of the tie rod 73.

As shown in FIG. 1B, the lower cone 55 is initially connected to the slip cage 49 by one or more shear pins 89. Lower cone 55 is also provided with a pair of passageways for receiving the tubular mandrels 23, 25 and also is provided with a passageway 91 into which is received the upper end 93 of a push rod 95. The upper end 93 of the push rod 95 is connected to the lower cone 55 by means of one or more shear pins 97. An upper abutment ring 99 surrounds the lower portion of the lower cone 55 and is located immediately above lower primary and secondary seal sections 101, 103, 105 identical to the upper seal assembly previously described. The push rod 95 and tubular mandrels 23, 25 pass through the solid seal assembly in the same manner that the tie rod 73 passes through the upper seal assembly.

Figure 1C:
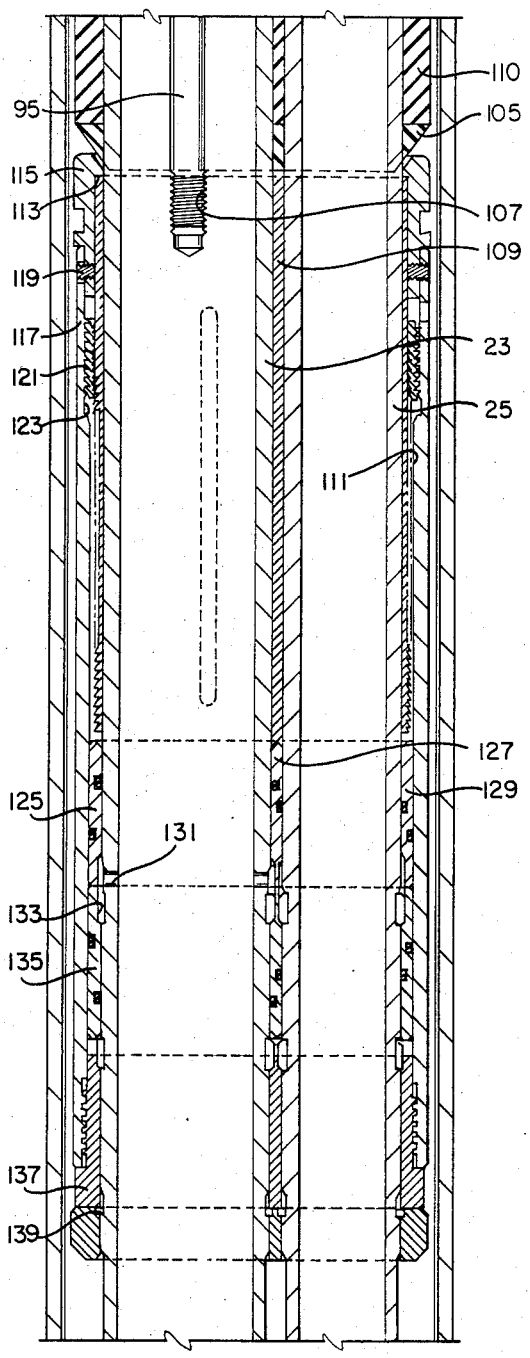

As shown in FIG. 1C, the push rod 95 is engaged within a threaded bore 107 provided in the upper end of a solid lock body 109. The lock body 109 is a solid metal body having passageways therethrough for the tubular mandrels 23, 25 and having a grooved outer surface 111. The upper edge of the lock body 109 is received beneath a shoulder 113 provided within the interior of the lower abutment ring 115. An outer sleeve 117 is shear pinned by pins 119 to the abutment ring 115 and surrounds the grooved outer surface 111 of the lock body 109. A lock ring 121 is carried between the interior of the sleeve 117 and the grooved outer surface 111 within a region of increased diameter 123. The lock ring 121 has an outer serated surface which engages the interior of the sleeve 117 and a serated interior surface which allows the lock ring 121 to slide along the grooved surface of the lock body in one direction, but which resists opposite relative movement between the lock ring and lock body.

Figure 1D:
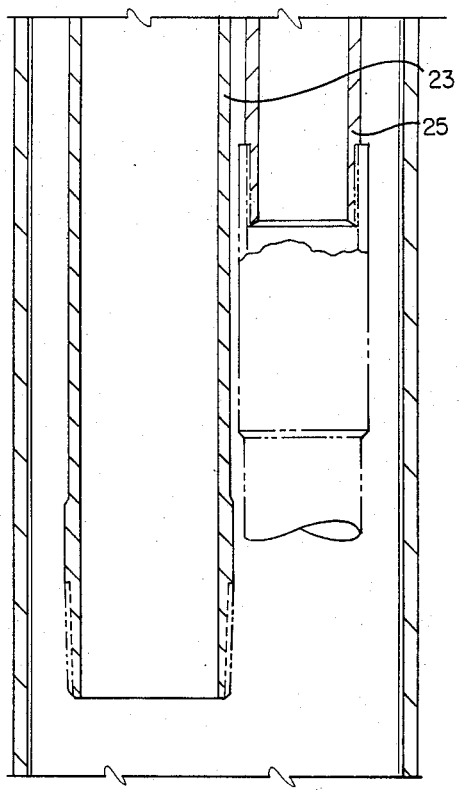
Figure 2A:
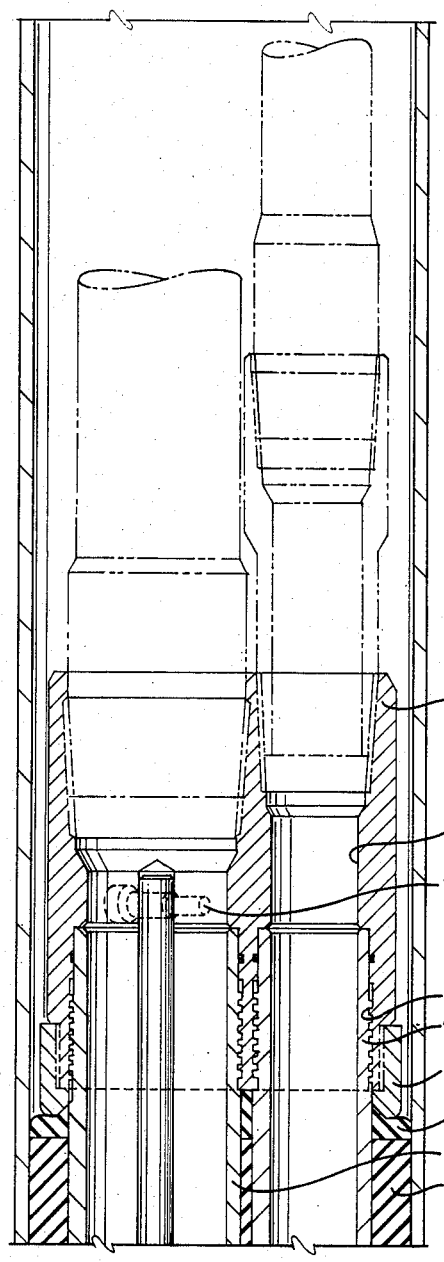
FIGS. 2A–2D are side, cross-sectional views of the well packer, similar to FIGS. 1A–1D, showing the compression of the top seal of the packer.
Figure 2B:
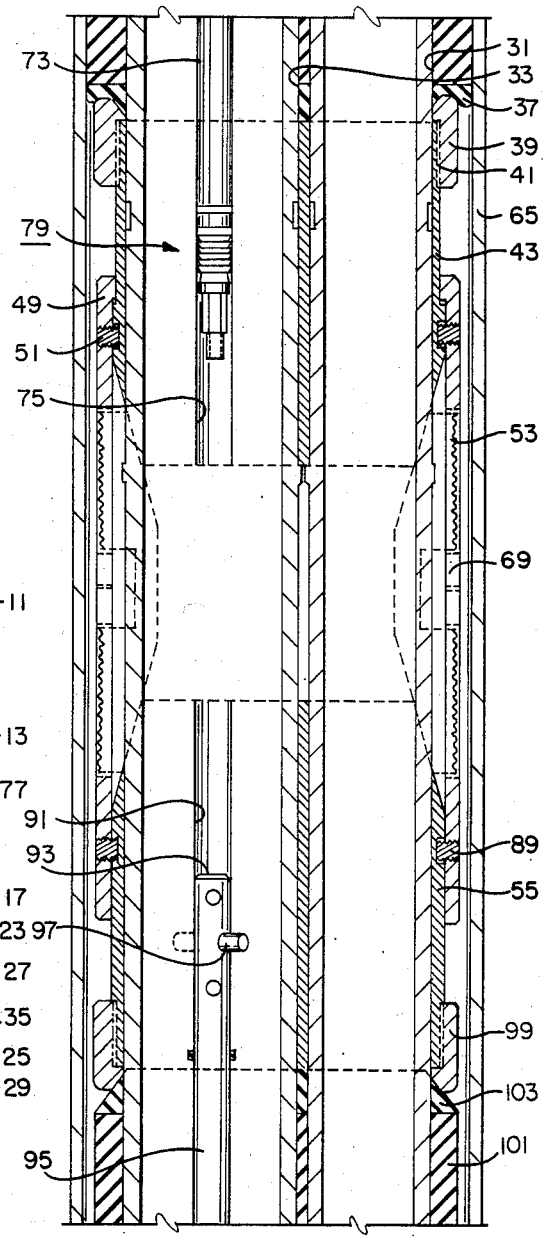
Figure 2C:
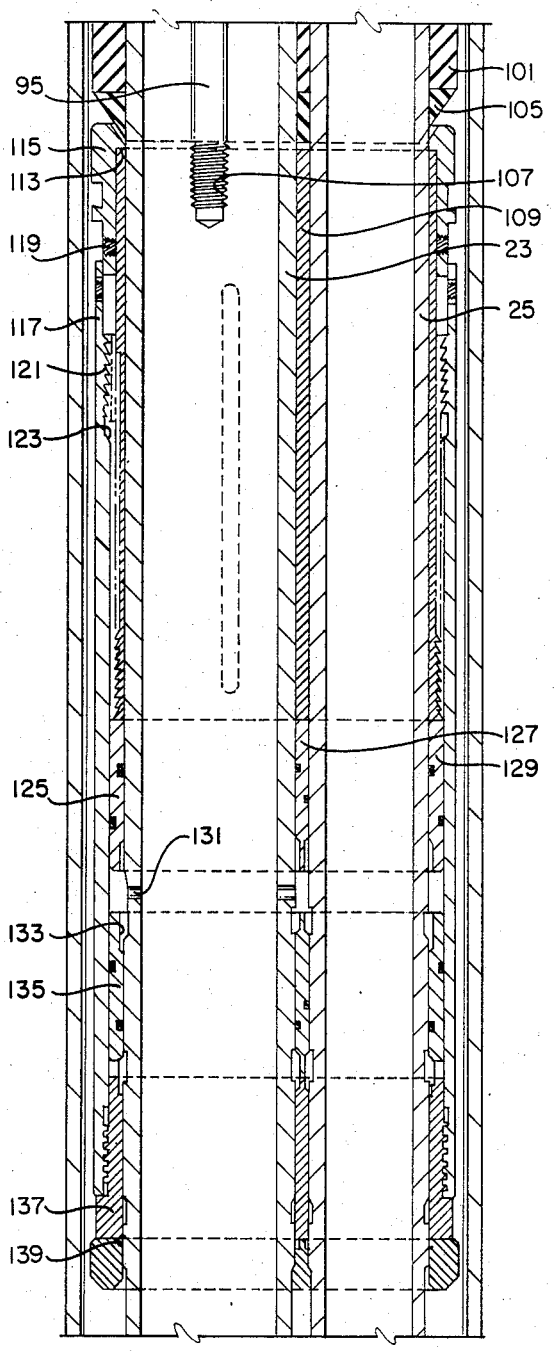
Figure 2D:
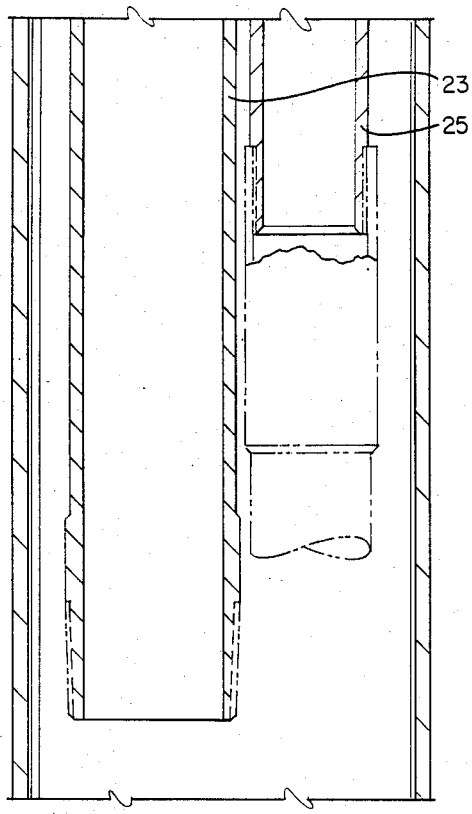

Immediately below the lock body and surrounded by the sleeve 117 are piston regions 125, 127, 129. The tubular mandrels 23, 25 are provided with one or more fluid ports 131 for communicating pressurized tubing fluid to the annular recess provided between the upper piston region 125 and a lower piston region e.g. region 135 in FIG. 1C The sleeve 117 is threadly connected to a lower body ring 137 at the lower extent thereof. A square shear wire 139 is received within a groove provided in the interior of the body ring 137 and rests upon a shoulder provided on the mandrel 23 to initially affix the body ring 137 and hence the sleeve 117 to the mandrel 23. As shown in FIG. 1D, the tubular mandrels 23, 25 can continue downwardly in the well bore and can run, for instance, to different producing zones within the well.

The operation of the well packer of the invention will now be described. In order to set the gripping and sealing assemblies, a selected one of the tubular mandrels is, e.g., mandrel 23, is first closed off at a point below the ports 131. This can be accomplished, for instance, by dropping a ball to land upon a shoulder (not shown) at a point lower down within the tubular mandrel 23. The mandrel 23 is then pressurized with tubing fluid from the well surface which exerts opposing forces upon the piston region 125, 135. The force exerted upon the piston regions tends to cause an opposite relative movement between the lock body 109 and the outer sleeve 117, causing the shear pins 119 to sever.

Once the predetermined pressure level has been reached which shears the pins 119, the setting force caused by the tubing pressure acts through the lock body 109 and push rod 95 to move the gripping assembly, as a unit, in the direction of the upper seal. That is, the push rod which is secured to the lock body at the threaded surface 107 and which is secured to the lower cone 55 by shear pin 97 isolates the lower seal 101 from the compressive force. The slip cage 49 is initially attached to the upper and lower cones by shear pins 51, 89, which causes the lower cone 55, slip cage 49 and upper cone 43 to push the abutment ring 39 in the direction of the upper seal 29 to compress the upper seal 29 into sealing engagement with the surrounding casing. As the upper cone 43 moves in the direction of the upper seal 29, the tie rod 73 moves within the passageway 75 provided in the upper cone 43. Although the lock means allows the upper cone to move in the direction of upper seal 29, the slip ring 83 and cone ring 81 engage the cylindrical side walls of the passageway 75 and prevent opposite relative sliding movement of the upper cone.

Figure 3A:
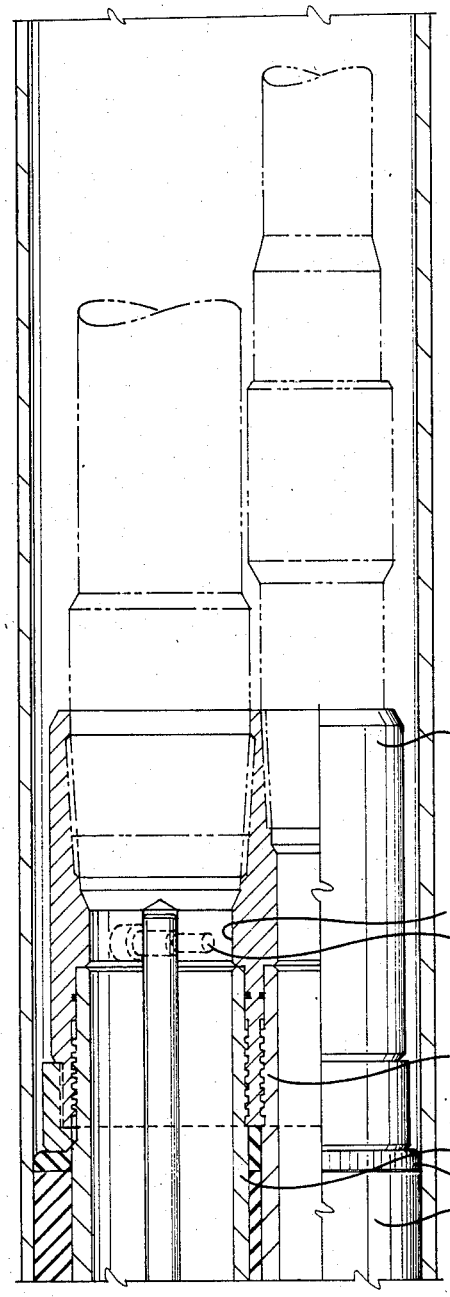
FIGS. 3A–3B are similar to FIGS. 2A–2B and show the initial movement of the gripping assembly of the packer.
Figure 3B:
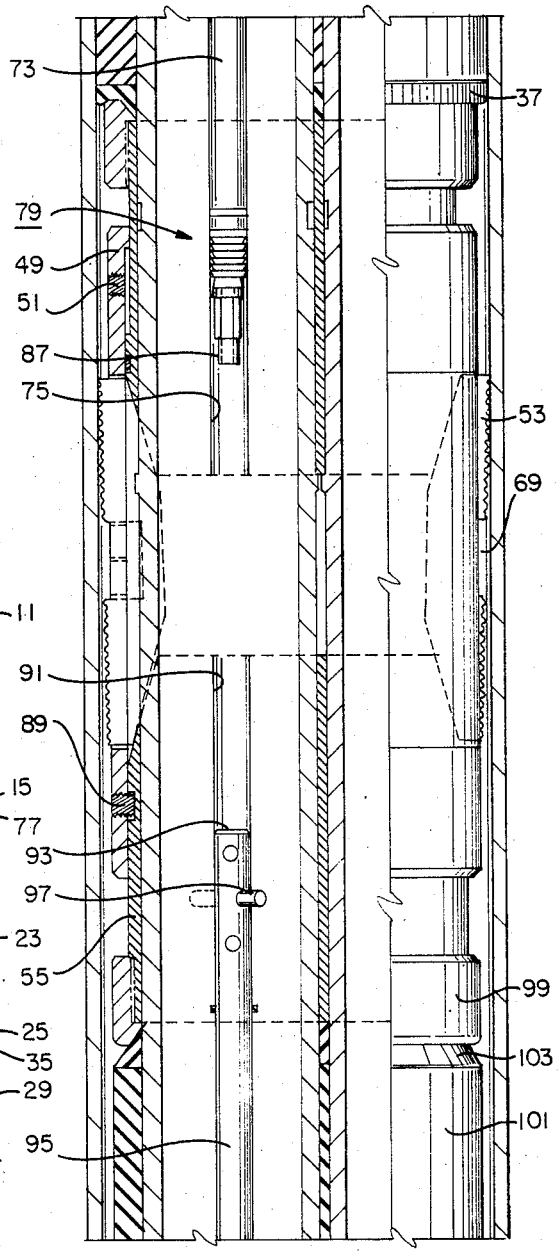
Figure 4A:
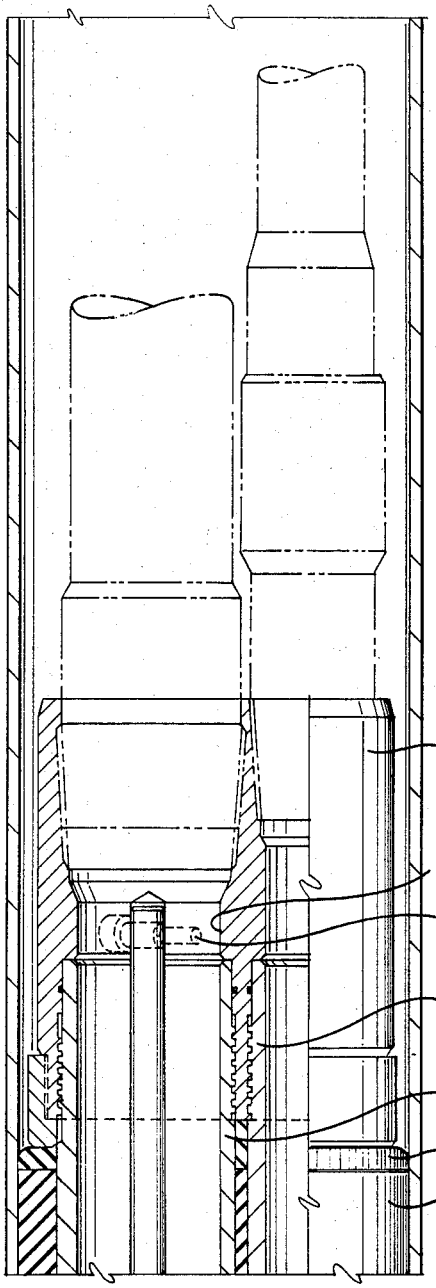
FIGS. 4A–4B are similar to FIGS. 3A–3B and show the continuation of the setting movement of the gripping assembly of the packer.
Figure 4B:
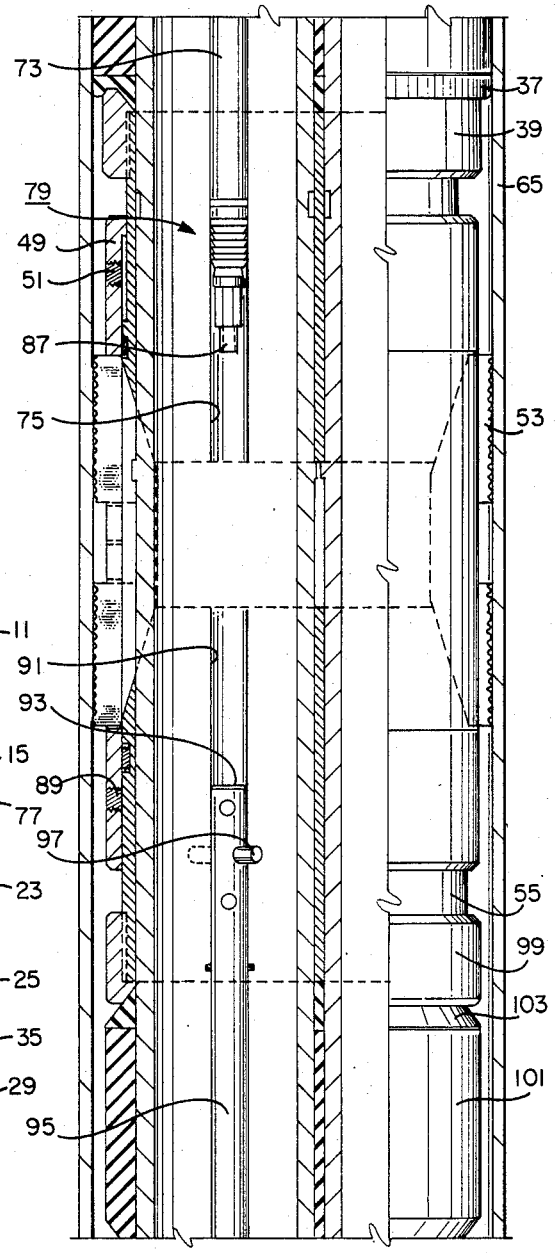
Figure 5A:
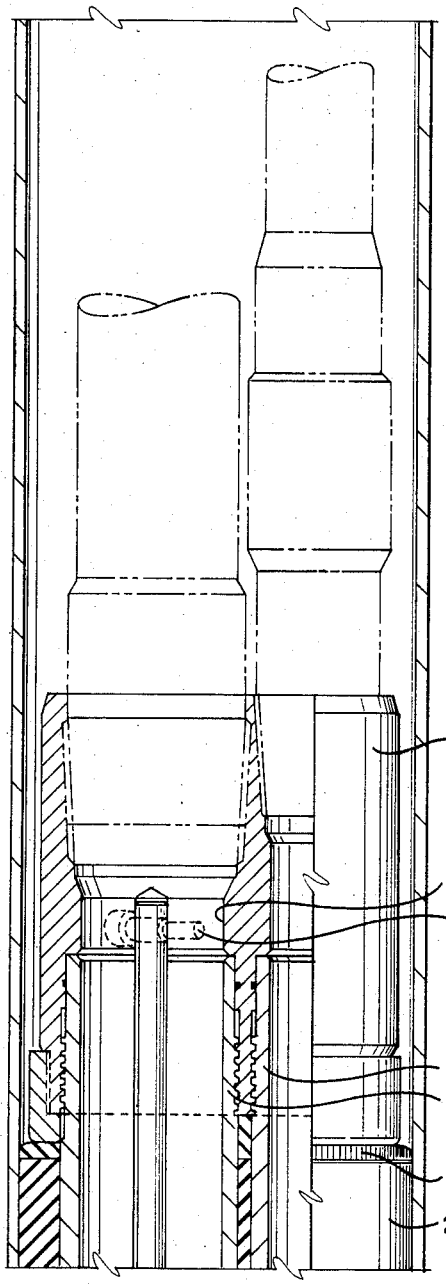
FIGS. 5A–5B are similar to FIGS. 4A–4B and show the compression of the lower seal during the final stage of the setting operation.
Figure 5B:
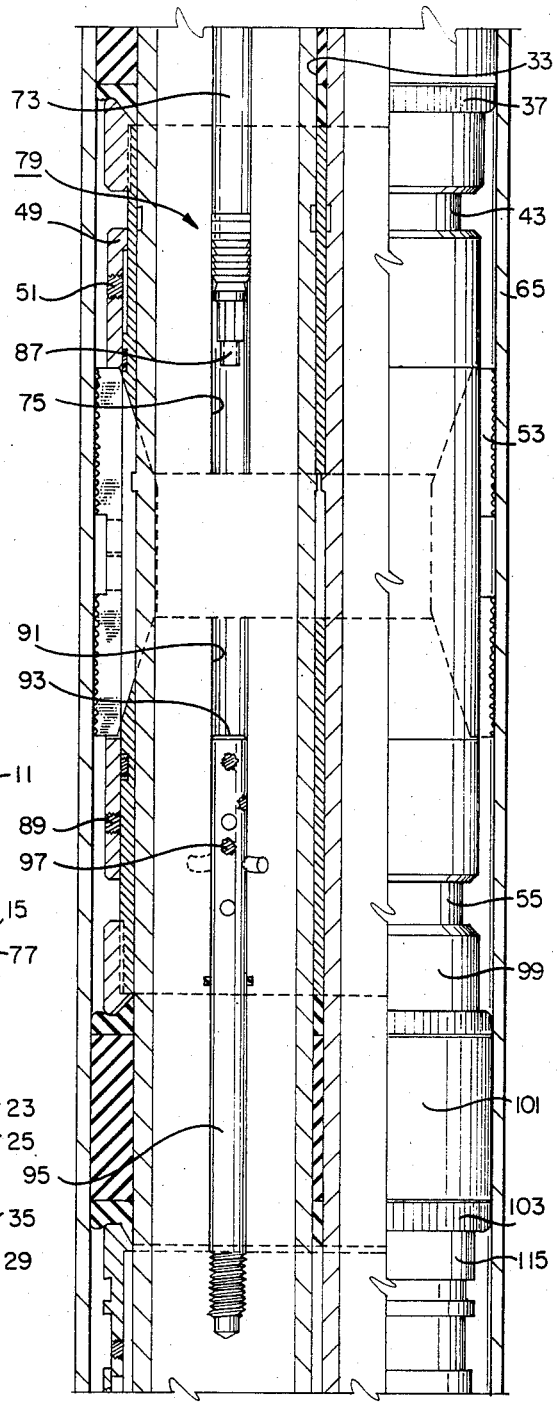

The strength of the shear pins 51 holding the upper cone 43 to the slip cage 49 is selected so that these pins are next to sever after sufficient compressive force has been applied to the upper seal 29. Shearing of the pins 51 allows the upper cone tapered surface 61 to ride beneath the lower tapered surface 57 of the slip elements causing the upper end of the slip to rock radially outwardly and engage the well casing (FIG. 3B). Continued application of tubing pressure within the tubular mandrel 23 causes the shear pins 89 to sever at the lower end of the slip cage 49, thereby allowing the lower cone 55 to ride beneath the lower tapered surface 59 of the slips to complete the radial movement and engagement of the gripping slips (FIG. 4B).

As tubing pressure continues to be increased, a predetermined shear index is reached, causing the shear pin 97 to shear which initially connected the push rod 95 to the lower cone 55. Once the pin 97 has sheared, the push rod 93 is free to slide within the passageway 91 which allows the lock body 109 to compress the lower seal 101 and complete the setting operation. The opposite pitch of the serated surfaces on the lock ring 121 and the outer surface of the lock body 109 locks the setting force into the lower seal 101 and maintains the tool in the set position. The tubing pressure can now be relieved and well bore operations conducted.

To release the well tool, the tubing string which is connected to the packer head 11 is lifted from the well surface. A straight upward pull on the tubing string shears off the nut 85 and relaxes the lock means of the tie rod, causing the lock means to fall off the tie rod within the passageway 75. This relaxes the top seal. A continued upward pull causes the upper cone 43 to engage the shoulder 141 within the slip cage 49, thereby raising the slip cage and retracting the gripping element. The described movements also cause the square shear wire 139 at the bottom of the tool to shear and thereby relax the lower seal 101. The tool can then be retrieved from the well bore.

Figure 8:
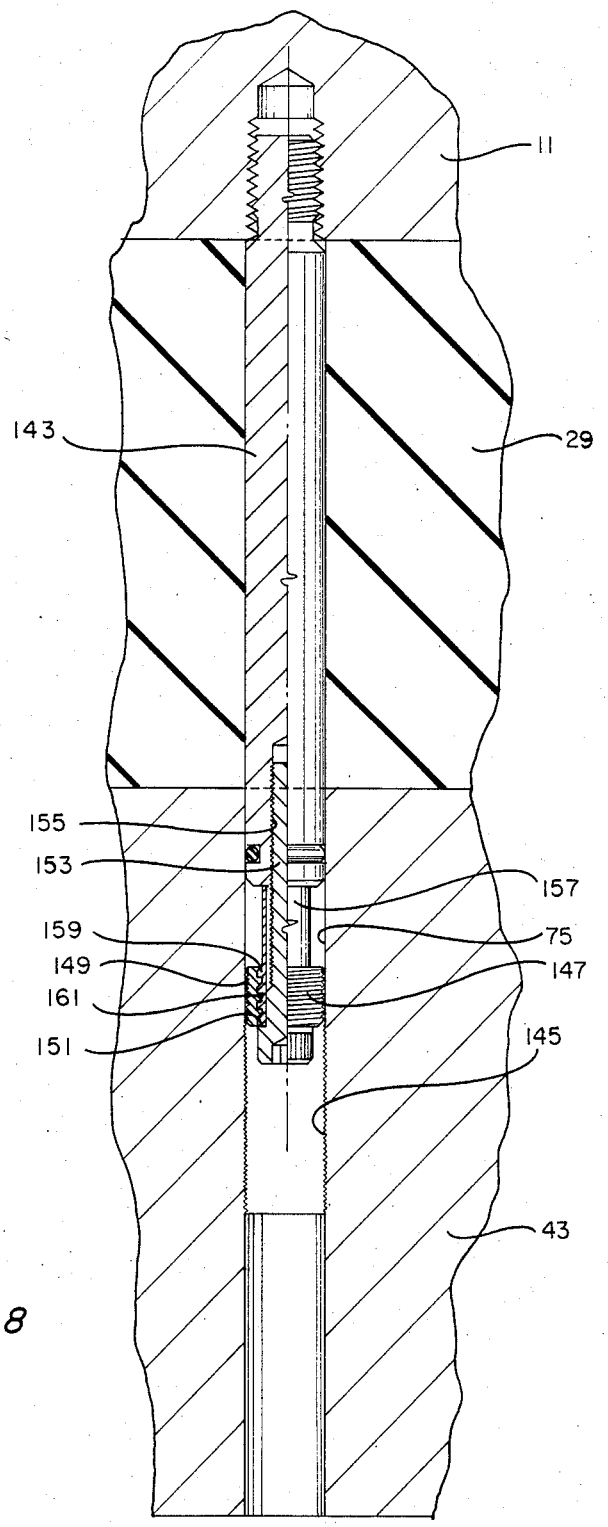
FIG. 8 is an isolated, cross-sectional view of a tie rod used to lock setting force into the upper seal of the packer.

FIG. 8 shows another embodiment for the tie rod 73 which is used to lock the setting force in the top seal 29. In this embodiment, rod 143 is received within the passageway 75 machined in the upper cone 43. In the embodiment of FIG. 8, however, a portion of the length of the passageway 75 is internally threaded at 145. A body lock ring 147 having an outer serated surface 149 is carried on the end of the tie rod 143 and retained in position by a shoulder 151 on a threaded shaft 153 which is received within a bore 155 on the end of the tie rod 143. A sleeve member 157 is received between the shoulder 151 and the end of the tie rod 143 and has outer wicker teeth 159 which are received within oppositely tapered grooves 161 in the body lock ring 147. The body lock ring 147 is split at one circumferential location (not shown). The wicker teeth 159 and cooperating grooves 161 cause the ring 147 to expand when urged in one direction, but allow a slight compression upon opposite relative movement. In this way, the upper cone 43 can travel in the direction of the upper seal 29, but opposite relative movement is not allowed.

An invention has been provided with several advantages. Because the top seal of the packer is set before the gripping assembly or lower seal, the lower seal does not contact the well casing, which eliminates the possibility of damaging the lower seal. Also, the tie rod and push rod allow setting of the twin seals without relative mandrel movement. Because the top seal and gripping assembly are set before setting the bottom seal, the tubing strings below the packer do not move downwardly during the final stages of the setting operation, which action could compress the tubing strings and weaken or damage the tubing.

While the invention has been shown in only two of its forms, it is not thus limited but is susceptible to various changes and modifications without departing from the spirit thereof.

I claim:

1. In a well packer of the type having a packer head and a pair of tubular mandrels extending downwardly therefrom, an upper seal located about the mandrels below the head, a gripping assembly located about the mandrels below the upper seal, a lower seal located about the mandrels below the gripping assembly, a lock body located about the mandrels below the lower seal, and actuator means within the lock body for causing outward radial movement of the seals and gripping assembly to seal and grip a surrounding well conduit, the improvement comprising:

a push rod extending from the lock body through the lower seal to the gripping assembly for moving the gripping assembly, as a unit, in the direction of the upper seal to compress the upper seal before the lower seal is compressed;

a tie rod extending from the packer head through the upper seal to the gripping assembly; and lock means associated with the tie rod for allowing unidirectional movement of the gripping assembly with respect to the upper seal, whereby sealing force applied to the upper seal from the gripping assembly is locked into the upper seal.

2. In a well packer of the type having a packer head and a pair of tubular mandrels extending downwardly therefrom, an upper seal located about the mandrels below the head, a gripping assembly including an upper cone, a lower cone a slip cage containing the upper and lower cones, and a plurality of intermediately located slip members carried between the cones within the slip cage, the gripping assembly being located about the mandrels below the upper seal, a lower seal located about the mandrels below the gripping assembly, a lock body located about the mandrels below the lower seal, and actuator means within the lock body for causing outward radial movement of the seals and gripping assembly to seal and grip a surrounding well conduit, the improvement comprising:

a push rod extending from the lock body through the lower seal to the lower cone for moving the gripping assembly, as a unit, in the direction of the upper seal to compress the upper seal before the lower seal is compressed;

a tie rod extending from the packer head through the upper seal into a passageway formed in the upper cone; and lock means associated with the tie rod for allowing unidirectional movement of the tie rod within the passageway formed in the upper cone, whereby sealing force applied to the upper seal from the gripping assembly is locked into the upper seal.

3. The well packer of claim 2, wherein the upper and lower cones are connected to the slip cage by shearable connections; and the lock body comprises an inner cylindrical body having an outer serrated surface and an outer cylindrical sleeve having an interior surface having grooves with a taper which allows relative movement between the body and sleeve in one direction, but which prevents opposite relative movement.

4. The well packer of claim 3, wherein the tie rod has an outer extent with a gripping cone mounted on a tapered surface of the rod which allows movement of the upper cone in the direction of the upper seal, but which resists opposite relative movement of the upper cone due to the contact of the gripping cone with the passageway once a setting force has been applied to the upper seal.

5. The well packer of claim 3, wherein the passageway formed in the upper cone is provided with a grooved wall surface and wherein the tie rod is provided with a serrated outer surface which allows movement of the upper cone in the direction of the upper seal, but which resists opposite relative movement of the upper cone due to the contact of the serrated surface with the grooved wall once a setting force has been applied to the upper seal.

6. A method of setting a well packer within a well conduit, the packer being of the type having a packer head and a pair of tubular mandrels extending downwardly therefrom, an upper seal located about the mandrels below the head, a gripping assembly located about the mandrels below the upper seal, a lower seal located about the mandrels below the gripping assembly, a lock body located about the mandrels below the lower seal, and an actuator means within the lock body for causing outward radial movement of the seals and gripping assembly to seal and grip a surrounding well conduit, comprising the steps of:

proving a push rod which extends from the lock body through the lower seal to the gripping assembly for moving the gripping assembly, as a unit, in the direction of the upper seal to compress the upper seal before the lower seal is compressed;

providing a tie rod which extends from the packer head through the upper seal to the gripping assembly;

providing lock means on the tie rod which allow unidirectional movement of the gripping assembly with respect to the upper seal, whereby sealing force applied to the upper seal from the gripping assembly is locked into the upper seal;

running the well packer to a desired depth within the well bore;

actuating the lock body to move the lower seal and gripping assembly, as a unit, in the direction of the upper seal to compress the upper seal and lock the setting force into the upper seal;

continuing to actuate the lock body once the top seal is set to cause outward radial movement of the gripping assembly to grip the surrounding well conduit; and continuing to actuate the lock body to apply a setting force to the lower seal to compress the lower seal and lock the setting force into the lower seal.

7. A method of setting a well packer in a well conduit, the packer being of the type having a packer head and a pair of tubular mandrels extending downwardly therefrom, an upper seal located about the mandrels below the head, a gripping assembly including an upper and lower cones and a plurality of intermediately located slip members carried between the cones within the slip cage, the gripping assembly being located about the mandrels below the upper seal, a lower seal located about the mandrels below the gripping assembly, and an actuator means within the lock body for causing outward radial movement of the seals and gripping assembly to seal and grip a surrounding well conduit, comprising the steps of:

connecting the upper and lower cones to the slip cage by shearable connections;

providing a push rod which extends from the lock body through the lower seal to the gripping assembly for moving the gripping assembly, as a unit, in the direction of the upper seal to compress the upper seal before the lower seal is compressed;

providing a tie rod which extends from the packer head through the upper seal to the gripping assembly;

providing lock means on the tie rod which allow unidirectional movement of the gripping assembly with respect to the upper seal, whereby sealing force applied to the upper seal from the gripping assembly is locked into the upper seal;

running the well packer to a desired depth within the well bore;

actuating the lock body to move the lower seal and gripping assembly, as a unit in the direction of the upper seal to compress the upper seal and lock the setting force into the upper seal;

continuing to actuate the lock body once the top seal is set to shear the shearable connections between the upper and lower cones and the slip cage to cause outward radial movement of the slips to grip the surrounding well conduit; and continuing to actuate the lock body to apply a setting force to the lower seal to compress the lower seal and lock the setting force into the lower seal.

* * * * *